US007553030B2

(12) United States Patent
Suzuki

(10) Patent No.: US 7,553,030 B2
(45) Date of Patent: Jun. 30, 2009

(54) FAN UNIT AND OPTICAL APPARATUS

(75) Inventor: Ryuji Suzuki, Iwatsuki (JP)

(73) Assignee: Canon Kabushiki Kaisha, Tokyo (JP)

( * ) Notice: Subject to any disclaimer, the term of this patent is extended or adjusted under 35 U.S.C. 154(b) by 464 days.

(21) Appl. No.: 11/210,048

(22) Filed: Aug. 22, 2005

(65) Prior Publication Data

US 2006/0062670 A1 Mar. 23, 2006

(30) Foreign Application Priority Data

Sep. 17, 2004 (JP) ..... 2004-271037

(51) Int. Cl.

| | |
|---|---|
| ***G03B 21/26*** | (2006.01) |
| ***G03B 21/16*** | (2006.01) |
| ***G03B 21/14*** | (2006.01) |
| ***G06F 15/76*** | (2006.01) |

(52) U.S. Cl. ..... 353/57; 353/60; 353/61; 353/119; 388/907.5; 712/32

(58) Field of Classification Search ..... 353/57, 353/52, 60, 61, 119; 388/907.5; 712/32
See application file for complete search history.

(56) References Cited

U.S. PATENT DOCUMENTS

| | | | | |
|---|---|---|---|---|
| 5,281,106 | A | 1/1994 | Reinhardt et al. | |
| 6,322,042 | B1 * | 11/2001 | Nemec | 248/694 |
| 6,375,440 | B2 * | 4/2002 | Kosugi | 417/423.14 |
| 6,924,979 | B2 * | 8/2005 | Clements et al. | 361/695 |
| 7,350,926 | B2 * | 4/2008 | Fukuda et al. | 353/55 |
| 2003/0039546 | A1 * | 2/2003 | Liu | 415/213.1 |
| 2005/0106008 | A1 * | 5/2005 | Park et al. | 415/119 |

FOREIGN PATENT DOCUMENTS

| | | | |
|---|---|---|---|
| CN | 2414241 | | 1/2001 |
| JP | 62-34243 | U1 | 2/1987 |
| JP | 9-270975 | A | 10/1997 |
| JP | 2000-27799 | A | 1/2000 |
| JP | 2001-313483 | A | 11/2001 |

* cited by examiner

*Primary Examiner*—Diane I Lee
*Assistant Examiner*—Magda Cruz
(74) *Attorney, Agent, or Firm*—Canon U.S.A., Inc. I.P. Division

(57) ABSTRACT

A projector includes a fan unit having a fan, supporting members functioning as a supporting base of the fan, and at least one resilient member operatively connected to the fan. The supporting members include a first supporting portion and a second supporting portion distant from the first supporting portion in the axis direction of the resilient member.

10 Claims, 5 Drawing Sheets

FAN UNIT AND OPTICAL APPARATUS

BACKGROUND OF THE INVENTION

1. Field of the Invention

The present invention relates to a fan unit and more particularly, though not exclusively, a fan unit including a cooling fan, and an optical apparatus including the fan unit.

2. Description of the Related Art

In optical apparatuses, such as a projector, if a cooling fan is supported by a support member (e.g., a housing), vibration of the fan is transferred to the support member, and therefore, noise is produced. A vibration-dampening structure can facilitate the minimization of the noise. In an operational situation, the noise can provide an irritating environment for audiences during projector use.

Conventionally, some optical apparatuses have a vibration-dampening structure in which rubber cushions are disposed on both sides of the peripheries of mounting holes formed in a fan assembly and the fan assembly is secured between the rubber cushions by screws to reduce the transfer of vibration to a supporting member (refer to, for example, Japanese Patent Laid-Open No. 9-270975, in particular, paragraphs 0010 through 0011 and FIG. 1). Additionally, a vibration-dampening structure has been discussed in which rubber cushions (bushings) are incorporated into a notch formed in a fan assembly and the rubber cushions are secured to a supporting member by screws to reduce the transfer of vibration to the supporting member (refer to, for example, Japanese Patent Laid-Open No. 2000-27799, in particular, paragraphs 0019 through 0029 and FIG. 1). Furthermore, a vibration-dampening structure has been discussed in which a fan assembly includes rubber cushions at its four corners and the fan assembly is supported by a supporting member via the rubber cushions to reduce the transfer of vibration to the supporting member (refer to, for example, Japanese Patent Laid-Open No. 2001-313483, in particular, paragraphs 0018 through 0021 and FIG. 3).

Still furthermore, a vibration-dampening structure has been discussed in which a resilient shaft is disposed in a mounting hole formed in a fan assembly and the resilient shaft is supported by a supporting member to prevent the fan assembly from being in direct contact with the supporting member, thus reducing the transfer of vibration to the supporting member (refer to, for example, Japanese Unexamined Utility Model Registration Application Publication No. 62-34243, in particular, the Claims and FIG. 4).

However, in the vibration-dampening structure discussed in Japanese Patent Laid-Open No. 9-270975, the productivity of assembling the fan unit significantly deteriorates, and therefore, the number of assembling steps and the cost increase. This is because the fan assembly needs to be secured to the supporting member by screws while preventing the rubber cushions from being shifted from the mounting holes formed in the fan assembly. In addition, since the rubber cushions are compressed by the screws, the elastic force of the rubber cushions is reduced. Consequently, the vibration-dampening effect is reduced.

In contrast, the vibration-dampening structure discussed in Japanese Patent Laid-Open No. 2000-27799 has a good productivity of attaching the rubber cushions to the fan unit. However, like the vibration-dampening structure disclosed in Japanese Patent Laid-Open No. 9-270975, since the rubber cushions are compressed by the screws, the elastic force of the rubber cushions is disadvantageously reduced. In the vibration-dampening structure discussed in Japanese Patent Laid-Open No. 2001-313483, the rubber cushions are not compressed by the screws, and therefore, the vibration-dampening effect is not reduced. However, the contact areas between the rubber cushions disposed at the four corners of the fan assembly and the supporting member are large. This results in the easy transfer of the vibration of the fan to the supporting member.

In the vibration-dampening structure discussed in Japanese Unexamined Utility Model Registration Application Publication No. 62-34243, since only the resilient shaft is in contact with the supporting member, the contact area is small. However, since the fan assembly is supported at only one side thereof (i.e., in a cantilever manner), the fan assembly may be tilted due to its own weight. Accordingly, the blow direction of cooling air is unstable, and therefore, it can be difficult to cool a desired location. In the case where the fan assembly is used to, for example, cool a light source lamp of an image projection apparatus, if the desired location is not cooled, the cooling performance decreases, which in turn decreases the luminance of the light source and a projected image.

SUMMARY OF THE INVENTION

An exemplary embodiment is directed toward a fan unit that facilitates ease-of-assembly and reduces the vibration of a fan transferred to a supporting member.

According to at least one exemplary embodiment, a fan unit includes a fan, a supporting member functioning as a supporting base of the fan, and a resilient member attached to the fan. The resilient member includes a first section and a second section spaced from the first section in the axis direction of the resilient member, and the supporting member includes a first supporting portion and a second supporting portion for supporting the first section and the second section of the resilient member.

According to at least one exemplary embodiment, the fan is not supported by the supporting member by screws. Additionally, in at least one exemplary embodiment the resilient member is not compressed by screws, further facilitating the reduction of noise. Furthermore, in at least one exemplary embodiment, the resilient member includes a first section and a second section spaced from the first section in the axis direction of the resilient member, with the supporting member supporting the two sections, thus the tilt of the fan due to its own weight is reduced.

Further features of the present invention will become apparent from the following description of exemplary embodiments with reference to the attached drawings.

DESCRIPTION OF THE EMBODIMENTS

Figure 1:
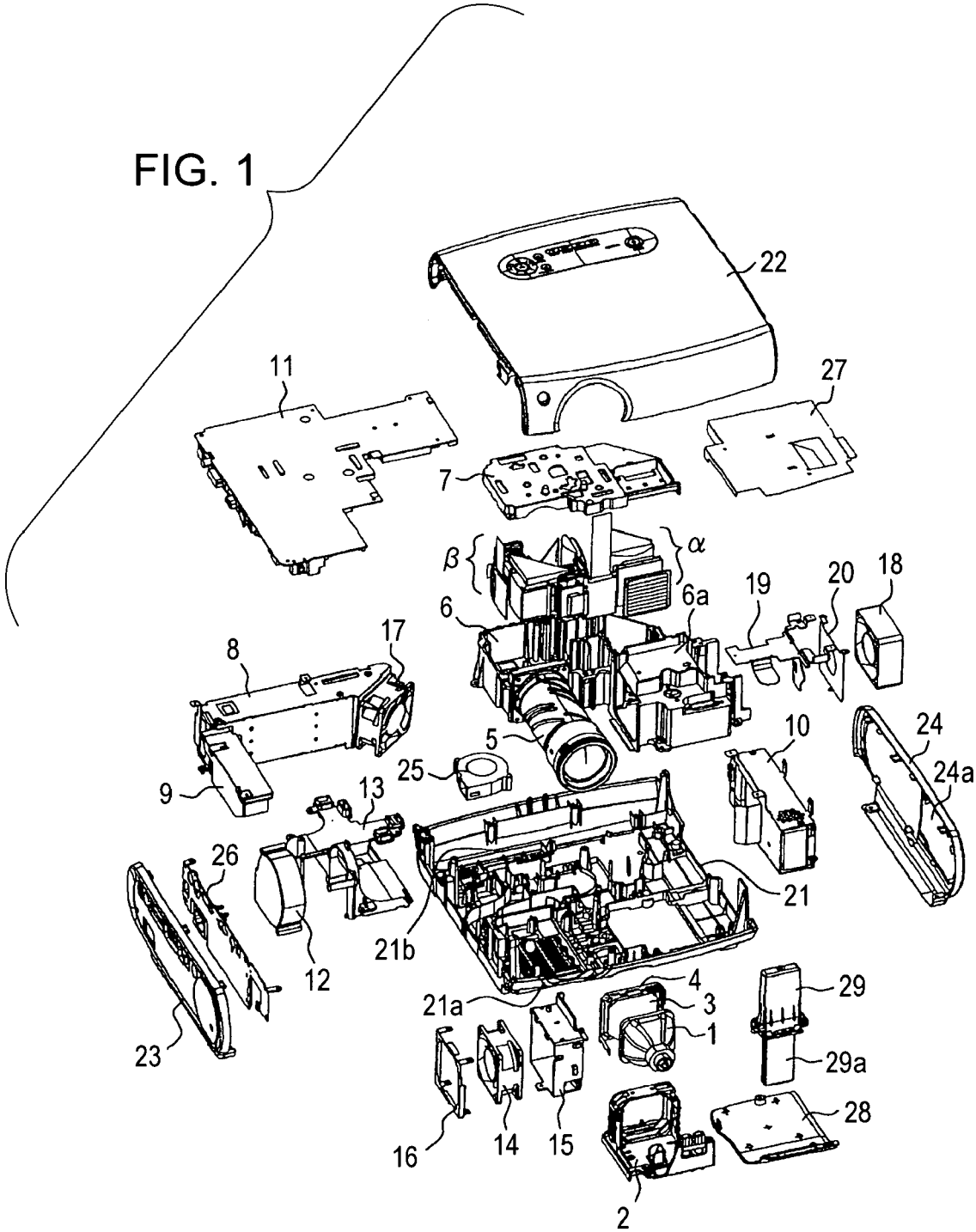
FIG. 1 illustrates an exploded perspective view of an image projection apparatus according to a first exemplary embodiment.

The following description of exemplary embodiment(s) is merely illustrative in nature and is in no way intended to limit the invention, its application, or uses.

Processes, techniques, apparatus, and materials as known by one of ordinary skill in the relevant art may not be discussed in detail but are intended to be part of the enabling description where appropriate. For example resilient member formation and manufacturing are not discussed in detail, however such processes as known by one of ordinary skill in the art and equivalent methods, processes, and materials would fall within the intended scope of exemplary embodiments.

Additionally exemplary embodiments are not limited to projector systems but can be used for any system that has noise and/or vibration due to a mechanical cooling system. For example the fan cooling system of a computer.

Notice that similar reference numerals and letters refer to similar items in the following figures, and thus once an item is defined in one figure, it may not be discussed for following figures.

Exemplary embodiments of the present invention are described with reference to the accompanying drawings.

First Exemplary Embodiment

<Overall Structure>

FIG. 1 illustrates the structure of an image projection apparatus (projector) including a light source unit according to a first exemplary embodiment. As illustrated in FIG. 1, the image projection apparatus includes a lamp unit 1, a lamp holder 2 for supporting the lamp unit 1, an explosion-proof glass 3, and a glass retainer 4.

The image projection apparatus also includes an illumination optical system α which inputs light emitted from the lamp unit 1 and a color separation and combination optical system β configured to separate colors of light output from the illumination optical system α and guiding the separated light to image-forming devices (e.g., liquid crystal display panels) for multiple color (e.g., three RGB (red, green, and blue)) components.

A projection lens barrel 5 projects projection light output from the color separation and combination optical system β onto a screen (projection surface: not shown). The projection lens barrel 5 includes a projection lens system, which is described later.

An optical box 6 includes the lamp unit 1, the illumination optical system α, and the color separation and combination optical system β. The projection lens barrel 5 is operatively connected to the optical box 6. In the optical box 6, a lamp case 6*a* can be formed to surround a portion of the lamp unit 1.

The image projection apparatus also includes an optical box cover 7, a power supply 8, a power supply filter 9, a ballast power supply 10 configured to power the lamp unit 1, and a circuit board 11. The optical box cover 7 covers the optical box 6 including the illumination optical system α and the color separation and combination optical system β. The circuit board 11 is configured to control an image forming device (e.g., a liquid crystal display panel) and the illumination of the lamp unit 1 using the power from the power supply 8.

The image projection apparatus also includes an optical system cooling fan 12 and a fan duct 13. The optical system cooling fan 12 cools an optical device (e.g., an image forming device such as the liquid crystal display panel in the color separation and combination optical system β), by drawing air from an intake port 21*a* of a cabinet 21, which is described later. The fan duct 13 delivers cooling air generated by the optical system cooling fan 12 to the optical device.

A lamp cooling fan 14 blows the cooling air to the lamp unit 1 in order to cool it. The lamp cooling fan 14 is disposed between the lamp unit 1 and the projection lens barrel 5.

The image projection apparatus also includes a fan holding platform 15 configured to hold the lamp cooling fan 14, a fan retainer plate 16, and a power supply cooling fan 17. The power supply cooling fan 17 distributes cooling air inside the power supply 8 by drawing air from the intake port 21*b* formed on a cabinet 21. The power supply cooling fan 17 cools the power supply 8 and the ballast power supply 10 at the same time by also blowing air to the ballast power supply 10.

The image projection apparatus also includes an exhaust fan 18 configured to discharge air blown by the lamp cooling fan 14 and heated by the lamp unit 1 and air that has cooled the ballast power supply 10 from an exhaust port 24*a* formed in a cabinet side panel 24 to outside the image projection apparatus. Note in at least one further exemplary embodiment the exhaust fan 18 can drive the cooling air through the system in addition to or without use of the lamp cooling fan 14.

The image projection apparatus also includes a lamp radiator plate 19 which dissipates heat from the lamp unit 1 and a lamp ventilation and light-shield mask 20 which functions as an air duct to allow heated air to pass through after cooling the lamp unit 1. The lamp ventilation and light-shield mask 20 also has a light-shield function to prevent light emitted from the lamp unit 1 from leaking to outside the image projection apparatus.

The image projection apparatus also includes the cabinet (lower casing) 21 for containing components including the optical box 6. The intake ports 21*a* and 21*b* can be formed in the cabinet 21. A cabinet cover (upper casing) 22 covers the cabinet 21 containing the optical box 6. A left cabinet side panel 23 is disposed at the left of the projection lens barrel 5 when viewed from the front of the image projection apparatus. A right cabinet side panel 24 is disposed at the right of the projection lens barrel 5. As described above, the exhaust port 24*a* can be formed in the right cabinet side panel 24.

The image projection apparatus also includes a device cooling fan 25 for cooling an optical device (e.g., a polarizing device), which can be a part of the color separation and combination optical system β. The device cooling fan 25 blows air drawn from an intake port (not shown) of the cabinet 21 to the optical device through a duct (not shown) formed in the cabinet 21.

An interface reinforcing plate 26 is attached to the inner side of the left cabinet side panel 23. A cabinet radiator plate 27 is attached to the lamp case 6*a* to dissipate the heat from the lamp unit 1.

A lamp cover 28 is removably attached to the bottom surface of the cabinet 21 using fasteners (e.g., screws, bolts, pins, other fastening devices and techniques as known by one of ordinary skill, and equivalents) (not shown). A set adjustment leg 29 is secured to the cabinet 21. The height of a leg 29*a* of the set adjustment leg 29 is adjustable. By adjusting the height of the leg 29*a*, the tilt angle of the image projection apparatus can be adjusted.

<Optical Structure>

The structure of an image display optical system is described below with reference to FIG. 2. The image display optical system includes the above-described lamp unit 1, illumination optical system α, color separation and combination optical system β, an image forming device (e.g., reflective liquid crystal display device (e.g., liquid crystal display panel)), and a projection lens system 70 in the projection lens barrel 5.

Figure 2:
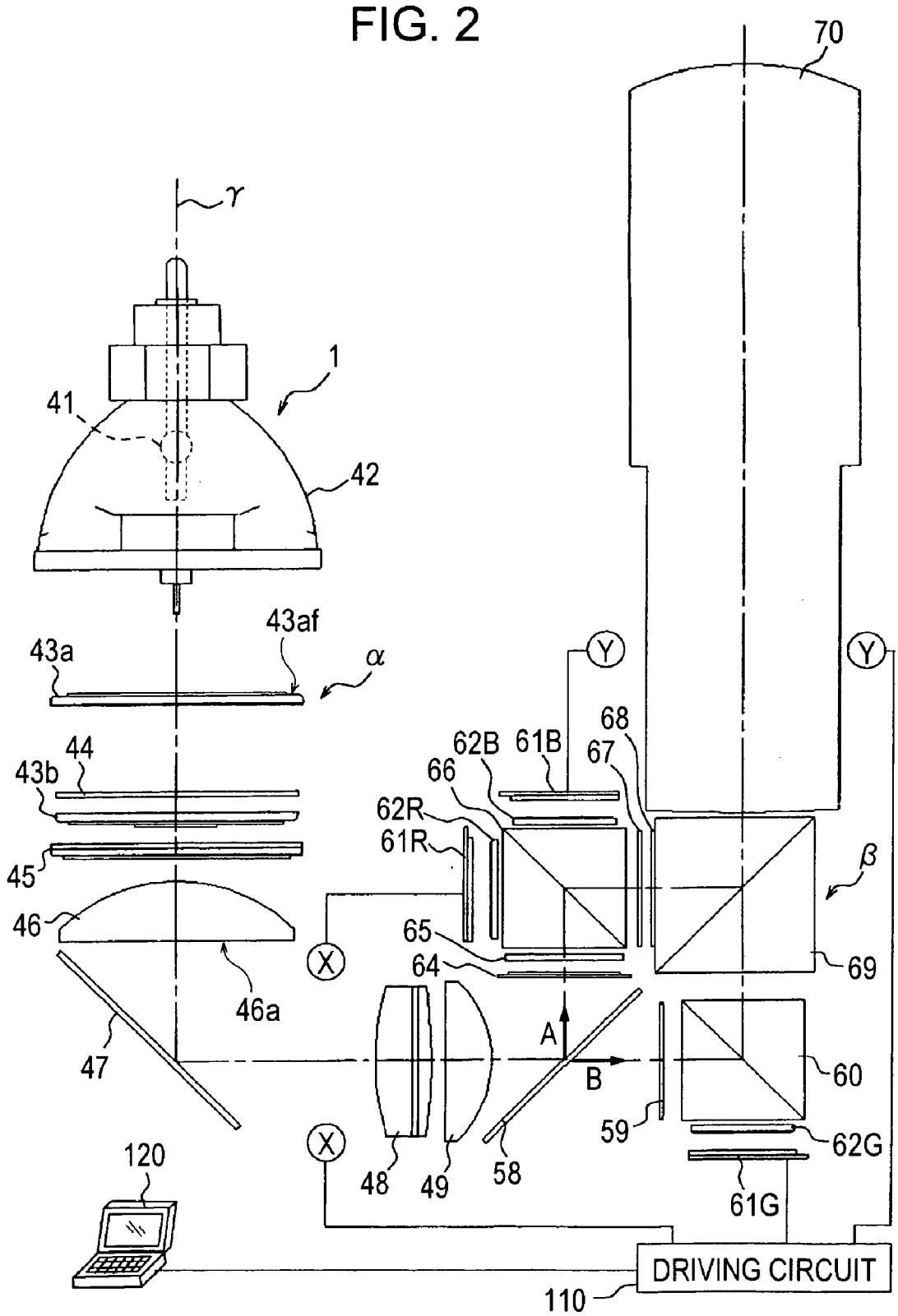
FIG. 2 illustrates the optical structure of the image projection apparatus according to the first exemplary embodiment.

As shown in FIG. 2, an arc tube 41 (e.g., an ultrahigh-pressure mercury lamp), emits white light, which can have a continuous spectrum and a reflector 42 reflects the light emitted from the arc tube 41 which is then collected in a predetermined direction. The lamp unit 1 includes the arc tube 41 and the reflector 42. γ represents the optical axis of an image projection optical system, namely, the direction in which the light emitted from the lamp unit 1 travels.

A first cylinder array 43*a* includes a first lens array having refracting power in a direction perpendicular to the plane of the cylinder array face 43*af* (hereinafter simply referred to as "vertical direction"). A second cylinder array 43*b* includes a second lens array, each lens element of which can correspond to a lens element of the first lens array. Also, the image display optical system includes an ultraviolet absorbing filter 44 and a polarization changer device 45. The polarization changer device 45 aligns nonpolarized light in a predetermined polarization direction.

A front compressor 46 includes a cylindrical lens having refracting power in the horizontal direction (e.g., substantially parallel to surface 46*a*). A mirror 47 changes the optical axis γ by a predetermined angle (e.g., about 90 degrees). The image display optical system also includes a condenser lens 48 and a rear compressor 49. The rear compressor 49 includes a cylindrical lens having refracting power in the horizontal direction. The above-described components are included within the illumination optical system α.

A dichroic mirror 58 reflects a first portion of the incident light (e.g., the wavelength corresponding to blue and red light) (A) and transmits a second portion of the incident light (e.g., the wavelength corresponding to green light) (B). The portion of light transmitted becomes incident on an incident light polarizing plate 59 (e.g., a polarizing device attached to a transparent substrate). The incident light polarizing plate 59 can be configured to transmit only S-polarized light. A first polarizing beam splitter 60 (e.g., a polarization split surface (polarization split film) between two triangular prism glass blocks) can be configured to transmits P-polarized light and reflect S-polarized light.

Reflective liquid crystal display devices 61R, 61G, and 61B handle red, green, and blue light components, respectively. The reflective liquid crystal display devices 61R, 61G, and 61B reflect incident light and modulate images. A driving circuit 110 is connected to the reflective liquid crystal display devices 61R, 61G, and 61B to drive them. An image information supplier apparatus 120 (e.g., an apparatus including a personal computer, a digital versatile disc (DVD) player, a video deck, and a TV tuner) can be connected to the driving circuit 110. The driving circuit 110 receives video (image) information from the image information supplier apparatus 120 so as to allow the reflective liquid crystal display devices 61R, 61G, and 61B to form an original image in accordance with the video information.

Quarter (¼) wavelength plates 62R, 62G, and 62B handle red, green, and blue light components, respectively. A polarizing plate 64 (e.g., including a polarizing device attached to a transparent substrate) can handle green and blue light components and can be configured to transmit only S-polarized light.

A first color-selective wave plate 65 rotates the direction of polarization of blue light by about 90 degrees but not that of red light. A second polarizing beam splitter 66 (e.g., a polarization split surface (polarization split film) between two triangular prism glass blocks) transmits P-polarized light and reflects S-polarized light. A second color-selective wave plate 67 rotates the direction of polarization of red light by about 90 degrees but not that of blue light.

An output light polarizing plate 68 polarizes red and blue light and can be configured to transmit only S-polarized light. A third polarizing beam splitter 69 (e.g., a polarization split surface (polarization split film) between two triangular prism glass blocks) transmits P-polarized light and reflects S-polarized light so as to function as a color combining optical member.

As described above, the color separation and combination optical system β includes the components from the dichroic mirror 58 through the third polarizing beam splitter 69.

<Optical Operation>

The optical operation of the above-described image display optical system is described next. Light emitted from the arc tube 41 is reflected by the reflector 42 and is collected in a predetermined direction. The reflector 42 has a paraboloidal surface. Light emitted from the focal point of the paraboloidal surface travels as light beams substantially parallel to the axis of symmetry of the paraboloidal surface. However, in practice, the light source of the arc tube 41 is not an ideal point light source. That is, the light source is of a finite size, and therefore, the collected light beams include many light components that are not parallel to the axis of symmetry of the paraboloidal surface. These light beams are incident on the first cylinder array 43*a*.

The light beams incident on the first cylinder array 43*a* are separated into a plurality of light beams for each cylinder lens and are then collected into a plurality of strip-shaped light beams traveling in the horizontal direction.

The plurality of light beams then pass through the ultraviolet absorbing filter 44 and the second cylinder array 43*b* so as to focus on the vicinity of the polarization changer device 45.

In the example provided, the polarization changer device 45 includes a polarization split surface, a reflecting surface, and a ½ wavelength plate, although other components can be used for the polarization changer device 45. The plurality of light beams are incident on the polarization split surface corresponding to each light beam and are divided into a transmitted P-polarized light component and a reflected S-polarized light component. The reflected S-polarized light component is reflected by the reflecting surface and is output towards the same direction as that of the P-polarized light component. On the other hand, the transmitted P-polarized light component passes through the ½ wavelength plate and is converted to the same polarizing light component as the S-polarized light component. Thus, light beams having the same polarization direction are output from the polarization changer device 45.

A plurality of the light beams having converted polarization pass through the front compressor 46 and are reflected at about 90 degrees by the mirror 47. The light beams then reach the condenser lens 48 and the rear compressor 49. By these optical operations, the front compressor 46, the condenser lens 48, and the rear compressor 49 overlap rectangular images of the plurality of light beams to each other so as to generate a rectangular uniform illumination area, where the reflective liquid crystal display devices 61R, 61G, and 61B are arranged.

The light which is converted to S-polarized light by the polarization changer device 45 is incident on the dichroic mirror 58. The dichroic mirror 58 reflects light with blue (430 to 495 nm) and red (590 to 650 nm) wavelengths and transmits light with green (505 to 580 nm) wavelengths.

The light path of green light (hereinafter referred to as "G light") is described next. G light passing through the dichroic mirror 58 (B) is incident on the incident light polarizing plate 59. The G light is S-polarized light after it is divided by the dichroic mirror 58. The G light is output from the incident light polarizing plate 59 and is then incident on the first polarizing beam splitter 60 while being S-polarized light. Thereafter, the G light is reflected by the polarization split surface of the first polarizing beam splitter 60 to reach the reflective liquid crystal display device 61G for the G light.

In the reflective liquid crystal display device 61G for the G light, the G light is image-modulated and reflected. An S-polarized light component of the image-modulated G light (reflected light) is reflected by the polarization split surface of the first polarizing beam splitter 60 again and is returned towards the light source. Thus, the S-polarized light component is eliminated from the projection light. In contrast, a P-polarized light component of the image-modulated G light passes through the polarization split surface of the first polarizing beam splitter 60 and travels towards the third polarizing beam splitter 69 as projection light. Here, by adjusting the slow axis of the ¼ wavelength plate 62G disposed between the first polarizing beam splitter 60 and the reflective liquid crystal display device 61G for the G light towards a predetermined direction while all of the polarizing components are converted to S polarizing components (i.e., while displaying black), nonuniform polarizing conditions occurring in the first polarizing beam splitter 60 and the reflective liquid crystal display device 61G can be decreased.

The G light output from the first polarizing beam splitter 60 is incident on the third polarizing beam splitter 69 while being P-polarized light. Subsequently, the G light passes through the polarization split surface of the third polarizing beam splitter 69 to reach the projection lens system 70.

The red and blue light (hereinafter referred to as "R light" and "B light", respectively) reflected by the dichroic mirror 58 is incident on the incident light polarizing plate 64. Note that the R and B light is S-polarized light after it is divided by the dichroic mirror 58. The R and B light is output from the incident light polarizing plate 64 and is then incident on the first color-selective wave plate 65. The first color-selective wave plate 65 rotates the direction of polarization of the B light by 90 degrees. Thus, the B light is incident on the second polarizing beam splitter 66 while being P-polarized light whereas the R light is incident on the second polarizing beam splitter 66 while being S-polarized light. The R light incident on the second polarizing beam splitter 66 while being S-polarized light is reflected by the polarization split surface of the second polarizing beam splitter 66 to reach the reflective liquid crystal display device 61R for R light.

The B light incident on the second polarizing beam splitter 66 while being P-polarized light passes through the polarization split surface of the second polarizing beam splitter 66 to reach the reflective liquid crystal display device 61B for B light.

The R light incident on the reflective liquid crystal display device 61R for R light is image-modulated and reflected. An S-polarized light component of the image-modulated R light (reflected light) is reflected by the polarization split surface of the second polarizing beam splitter 66 again and is returned towards the light source. Thus, the S-polarized light component is significantly reduced from the projection light. In contrast, a P-polarized light component of the image-modulated R light passes through the polarization split surface of the second polarizing beam splitter 66 and travels towards the second color-selective wave plate 67 as projection light.

The B light incident on the reflective liquid crystal display device 61B for B light is image-modulated and reflected. A P-polarized light component of the image-modulated B light (reflected light) passes through the polarization split surface of the second polarizing beam splitter 66 again and is returned towards the light source. Thus, the P-polarized light component is eliminated from the projection light. In contrast, an S-polarized light component in the reflected and image-modulated B light is reflected by the polarization split surface of the second polarizing beam splitter 66 and travels towards the second color-selective wave plate 67 as projection light.

At that time, as for the G light, by adjusting the slow axes of the ¼ wavelength plates 62R and 62B disposed between the second polarizing beam splitter 66 and the reflective liquid crystal display devices 61R and 61B for R and B light, respectively, the black display for each of the R and B light can be adjusted.

Thus, the R and B light is combined into one light beam, which is emitted from the second polarizing beam splitter 66. The direction of polarization of the R light in this light beam is rotated 90 degrees by the second color-selective wave plate 67 to become an S-polarized light component. Thereafter, the S-polarized light component is further polarized by the output light polarizing plate 68 and is then incident on the third polarizing beam splitter 69. The B light passes through the second color-selective wave plate 67 while being S-polarized light and is further polarized by the output light polarizing plate 68. The B light is then incident on the third polarizing beam splitter 69. Since the R and B projection light is polarized by the output light polarizing plate 68, unwanted components occurring while passing through the second polarizing beam splitter 66, the reflective liquid crystal display devices 61R and 61B for R and B light, and the ¼ wavelength plates 62R and 62B are significantly reduced from the R and B light.

The R and B projection light incident on the third polarizing beam splitter 69 is reflected by the polarization split surface of the third polarizing beam splitter 69 and is combined with the G light reflected by the polarization split surface, as described above. The combined light reaches the projection lens system 70. Thus, the combined R, G, and B projection light is projected on a projection surface, such as a screen, while being magnified by the projection lens system 70.

Since the above-described light path is in a white display mode of the reflective liquid crystal display device, the optical operation of the reflective liquid crystal display device in a black display mode is described next.

First, the light path of G light is described. G light (S-polarized light) passing through the dichroic mirror 58 (B) is incident on the incident light polarizing plate 59. Subsequently, the G light is incident on the first polarizing beam splitter 60 and is reflected by the polarization split surface of the first polarizing beam splitter 60 to reach the reflective liquid crystal display device 61G for G light. However, since the reflective liquid crystal display device 61G is in a black display mode, the G light is reflected without being image-modulated. Accordingly, since the G light reflected by the reflective liquid crystal display device 61G remains being S-polarized light, the G light is reflected by the polarization split surface of the first polarizing beam splitter 60 again. The G light reflected passes through the incident light polarizing plate 59 to return towards the light source, and therefore, the G light is significantly reduced from the projection light.

The light paths of R light and B light are described next. R light and B light (S-polarized light) reflected by the dichroic mirror 58 are incident on the incident light polarizing plate 64. The R light and B light are then output from the incident light polarizing plate 64 and are incident on the color-selective wave plate 65. The color-selective wave plate 65 only rotates the direction of polarization of B light by 90 degrees. Thus, the B light is incident on the second polarizing beam splitter 66 while being P-polarized light, whereas the R light is incident on the second polarizing beam splitter 66 while being S-polarized light.

The R light incident on the second polarizing beam splitter 66 while being S-polarized light is reflected by the polarization split surface of the second polarizing beam splitter 66 to reach the reflective liquid crystal display device 61R for R light. The B light incident on the second polarizing beam splitter 66 while being P-polarized light passes through the polarization split surface of the second polarizing beam splitter 66 to reach the reflective liquid crystal display device 61B for B light.

Since the reflective liquid crystal display device 61R is in a black display mode, the R light incident on the reflective liquid crystal display device 61R for R light is reflected without being image-modulated. Accordingly, since the R light reflected by the reflective liquid crystal display device 61R for R light remains being S-polarized light, the R light is reflected again by the polarization split surface of the first polarizing beam splitter 60. The R light reflected passes through the incident light polarizing plate 64 to return towards the light source, and therefore, the R light is significantly reduced from the projection light. That is, black is displayed on a projection surface. In contrast, since the reflective liquid crystal display device 61B for B light is in a black display mode, the B light incident on the reflective liquid crystal display device 61B for B light is reflected without being image-modulated. Accordingly, since the B light reflected by the reflective liquid crystal display device 61B for B light remains being P-polarized light, the B light passes through the polarization split surface of the first polarizing beam splitter 60 again. The B light is then converted to S-polarized light by the color-selective wave plate 65. Thereafter, the B light passes through the incident light polarizing plate 64 to return towards the light source, and therefore, the B light is eliminated from the projection light.

<Fan Supporting Structure>

Figure 3:
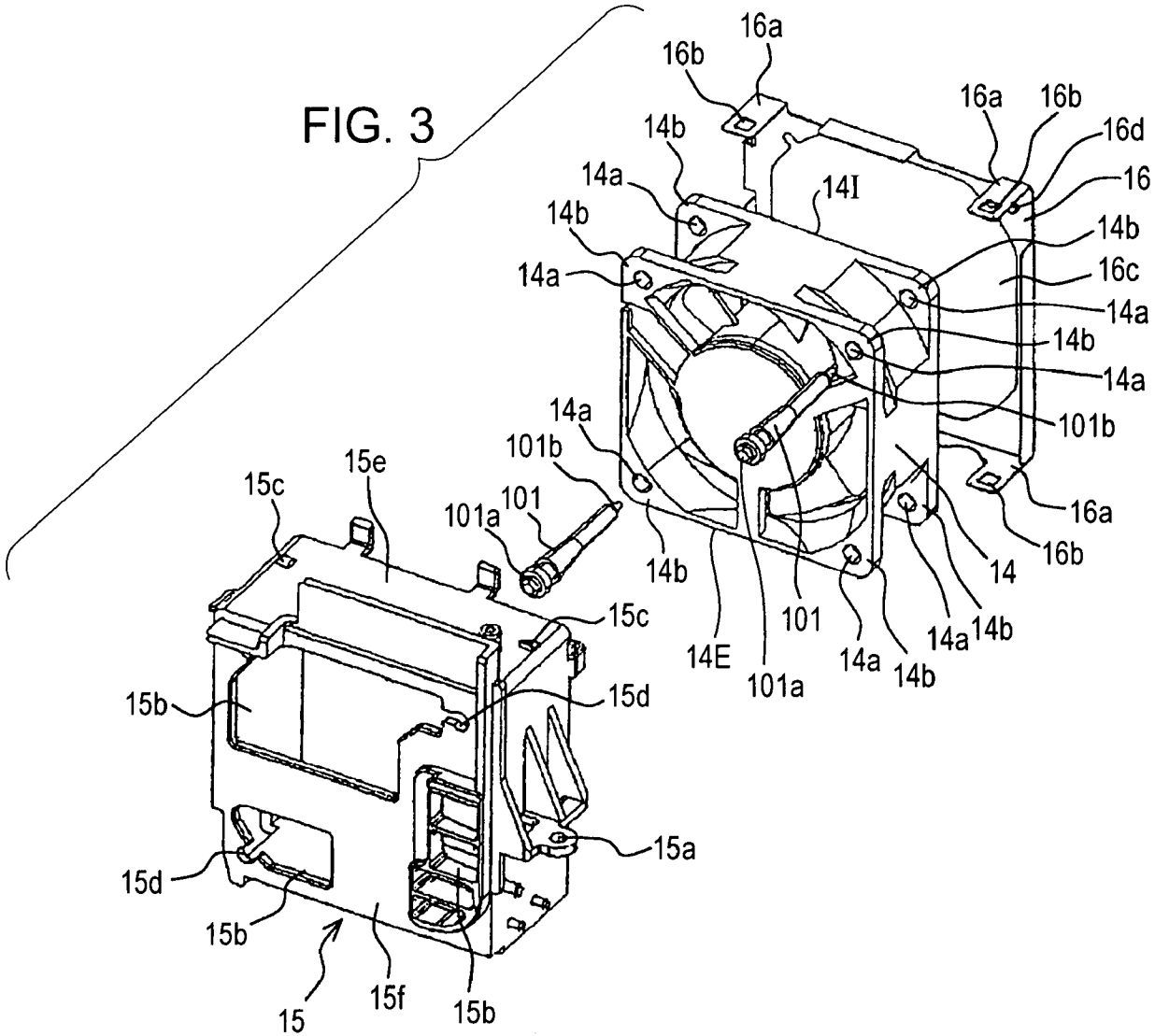
FIG. 3 illustrates an exploded perspective view of a fan unit according to the first exemplary embodiment.

The supporting structure of the lamp cooling fan 14 is described next with reference to FIGS. 3 and 4. The lamp cooling fan 14 is an axial fan which blows cooling air to the lamp unit 1, which can include a heating element, in order to cool the lamp unit 1. Rectangular flanges 14*b* are formed in the peripheries on both sides of the lamp cooling fan 14 in a direction of the fan rotation shaft of the lamp cooling fan 14 (i.e., on the intake port side 14I and the exhaust port side 14E). Additionally, mounting holes 14*a* are formed at four corners of each flange. That is, the mounting holes 14*a* are formed at eight locations: four locations on the flange 14*b* at the intake port side and four locations on the flange 14*b* at the exhaust port side.

The fan holding platform 15 is a first member of a holding base supporting the flange 14*b* at the exhaust port side of the lamp cooling fan 14. The fan holding platform 15 includes a rectangular frame 15*e* in which the lamp cooling fan 14 is mounted. In a wall portion 15*f* of the fan holding platform 15 facing the inner space of the rectangular frame 15*e*, a plurality of openings 15*b* are formed to allow cooling air discharged from the lamp cooling fan 14 to flow out in a predetermined direction. That is, the fan holding platform 15 also serves as an air guiding member like a duct. Additionally, mounting portions 15*a* are formed on the left and right outer surfaces of the fan holder 15 to secure the fan holding platform 15 to the cabinet 21 shown in FIG. 1.

After inserting the lamp cooling fan 14 to the rectangular frame 15*e* of the fan holder 15, the fan retainer plate 16 is attached to the fan holding platform 15 such that the fan retainer plate 16 covers the four corners of the opening of the rectangular frame 15*e*. The fan retainer plate 16 is a second member of the holding base supporting the flange 14*b* at the intake port side of the lamp cooling fan 14.

Resilient projection blades 16*a* are provided at four corners of the fan retainer plate 16. By engaging rectangular holes 16*b* formed in the resilient projection blades 16*a* with bumps 15*c* formed on the outer surface of the rectangular frame 15*e* of the fan holding platform 15, the fan retainer plate 16 is attached to the fan holding platform 15 as an integral part. Thus, the lamp cooling fan 14 is held so that the lamp cooling fan 14 does not come apart from the fan holding platform 15. Additionally, an opening 16*c* is formed in the fan retainer plate 16 in order to allow the lamp cooling fan 14 to draw outside air.

One end portion of a resilient supporting shaft 101 (e.g., an integrated member composed of a rubber material (e.g., butyl rubber or silicon rubber)) is inserted into the mounting hole 14*a* on the flange 14*b* at the intake port side and the other end portion is inserted into the mounting hole 14*a* which is on the flange 14*b* at the exhaust port side and which faces the mounting hole 14*a* on the flange 14*b* at the intake port side. Two resilient supporting shafts 101 can be used at two diagonal locations of the mounting holes 14*a*, that is, two symmetrically located mounting holes 14*a* with respect to the center of the ventilating opening of the lamp cooling fan 14. Accordingly, the resilient supporting shaft 101 can be attached to the lamp cooling fan 14 (i.e., insertion into the mounting holes 14*a*). In addition, the resilient supporting shaft 101 has bearing portions 101*a* and 101*b* at its ends. The bearing portion 101*a* is inserted into a circular notch portion (a first supporting portion) 15*d* formed in the wall portion 15*f* of the fan holding platform 15. Other methods of attachment can be used for the resilient supporting shaft and the discussion herein is not intended to limit the attachment into using the circular notch portion 15*d*. Similarly, the bearing portion 101*b* is inserted into a circular notch portion (a second supporting portion) 16*d* formed in the fan retainer plate 16. Additionally, in accordance with at least one exemplary embodiment, additional shapes of the notches (e.g., 15*d* and 16*d*) can be used other than circular.

Thus, both ends of the resilient supporting shaft 101 attached to the lamp cooling fan 14 are supported by a supporting member formed by the fan holding platform 15 and the fan retainer plate 16. In other words, two distant locations of the resilient supporting shaft 101 attached to the lamp cooling fan 14 are supported by the supporting member (i.e., the fan holding platform 15 and the fan retainer plate 16). That is, the lamp cooling fan 14 is supported while being suspended. In this case, the axis direction of the resilient supporting shaft 101 is substantially parallel to the rotation axis of the lamp cooling fan 14.

The shape of the resilient supporting shaft 101 and a method of mounting the lamp cooling fan 14 to the fan holding platform 15 are described in more detail with reference to FIG. 4. As described above, the resilient supporting shaft 101 has the bearing portions 101*a* and 101*b* at its ends. Furthermore, the resilient supporting shaft 101 can have a large-diameter portion 101*c*, a small-diameter-A portion 101*d*, a middle-diameter portion 101*e*, a tapered portion 101*f*, and a small-diameter-B portion 101*g* extending from the bearing portion 101*a* side (from the wall portion 15*f* of the fan holding platform 15).

For the resilient supporting shaft 101 having such a structure, the bearing portion 101*b* and the small-diameter-B portion 101*g* are inserted into the mounting hole 14*a*. Here, since the outer diameters of the bearing portion 101*b* and the small-diameter-B portion 101*g* are smaller than the inner diameter of the mounting hole 14*a*, the resilient supporting shaft 101 can be smoothly inserted.

When the tapered portion 101*f* reaches the mounting holes 14*a*, the diameter of the tapered portion 101*f* becomes small due to the rubber elasticity of the resilient supporting shaft 101. Therefore, the tapered portion 101*f* can also pass through the mounting hole 14*a*.

The tapered portion 101*f* passes through the mounting holes 14*a*. The middle-diameter portion 101*e* then passes through the mounting hole 14*a*. When the small-diameter-A portion 101*d* reaches the mounting holes 14*a*, the large-diameter portion 101*c* is brought into contact with the flange 14*b*. Therefore, the resilient supporting shaft 101 stops advancing. At that time, the mounting hole 14*a* is sandwiched between the large-diameter portion 101*c* and the middle-diameter portion 101*e*, and the small-diameter-A portion 101*d* fits the mounting hole 14*a*.

The small-diameter-B portion 101*g* is inserted into and fits the mounting hole 14*a* formed in the flange 14*b*. Thus, the resilient supporting shaft 101 is attached to the lamp cooling fan 14 so that the both end portions of the resilient supporting shaft 101 are urged into the mounting holes 14*a* on both intake port and exhaust sides of the lamp cooling fan 14.

Subsequently, the lamp cooling fan 14 to which the resilient supporting shaft 101 is attached is inserted into the rectangular frame 15*e* of the fan holding platform 15. The bearing portion 101*a* of the resilient supporting shaft 101 is then inserted into the notch portion 15*d* of the wall portion 15*f* of the fan holding platform 15. Thereafter, as described above, the fan retainer plate 16 is attached to the fan holding platform 15 and the bearing portion 101*b* of the resilient supporting shaft 101 is inserted into the notch portion 16*d* of the fan retainer plate 16. Thus, the assembly of the fan unit in which the lamp cooling fan 14 is supported by the fan holding platform 15 and the fan retainer plate 16 is completed.

Figure 4:
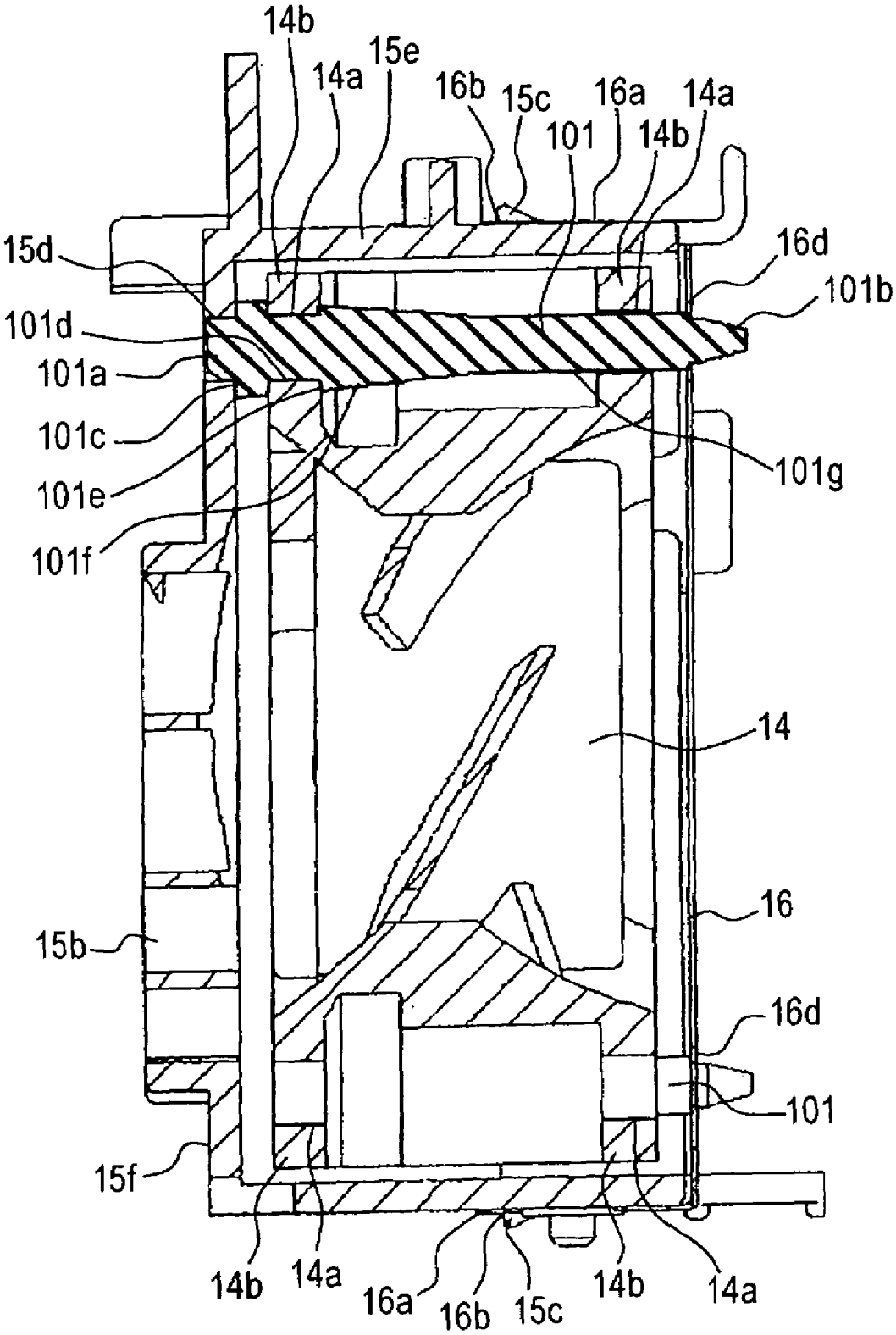
FIG. 4 illustrates a sectional view of the fan unit according to the first exemplary embodiment.

When the assembly is completed, as shown in FIG. 4, the lamp cooling fan 14 is supported by the fan holding platform 15 and the fan retainer plate 16 with predetermined spaces in all directions from the fan holding platform 15 and the fan retainer plate 16, that is, the lamp cooling fan 14 is suspended by the resilient supporting shaft 101. Moreover, the contact areas between the resilient supporting shaft 101 and the fan holding platform 15 and between the resilient supporting shaft 101 and the fan retainer plate 16 are significantly small. Consequently, the vibration of the lamp cooling fan 14, caused by the rotation thereof, transferred to the fan holding platform 15 is reduced. Where in at least one exemplary embodiment, the reduction is due to vibration damping effect resulting from the elasticity of the resilient supporting shaft 101 itself and the small contact areas described above. This effectively results in the reduction of the occurrence of noise that increases when the vibration of the lamp cooling fan 14 is transferred from the fan holding platform 15 to the cabinet 21 (see FIG. 1). Therefore, a noiseless high-quality fan unit and a superior image projection apparatus including the fan unit can be obtained.

Additionally, both sides of the lamp cooling fan 14 can be supported by the fan holding platform 15 and the fan retainer plate 16 via the resilient supporting shaft 101. Accordingly, although two diagonally disposed resilient supporting shafts 101 are used, the tilt of the lamp cooling fan 14 with respect to the fan holding platform 15 can be reduced. Therefore, cooling air appropriately flows from the lamp cooling fan 14 to the lamp unit 1, thus reducing problems such as insufficient brightness of the lamp unit 1 and the projected image. As a result, exemplary embodiment of the fan arrangement can facilitate the configuration of an image projection apparatus having a high cooling performance can be obtained. Note that further exemplary embodiments can have any number of resilient supporting shafts and placement (e.g., 3 or 4).

Second Exemplary Embodiment

Figure 5:
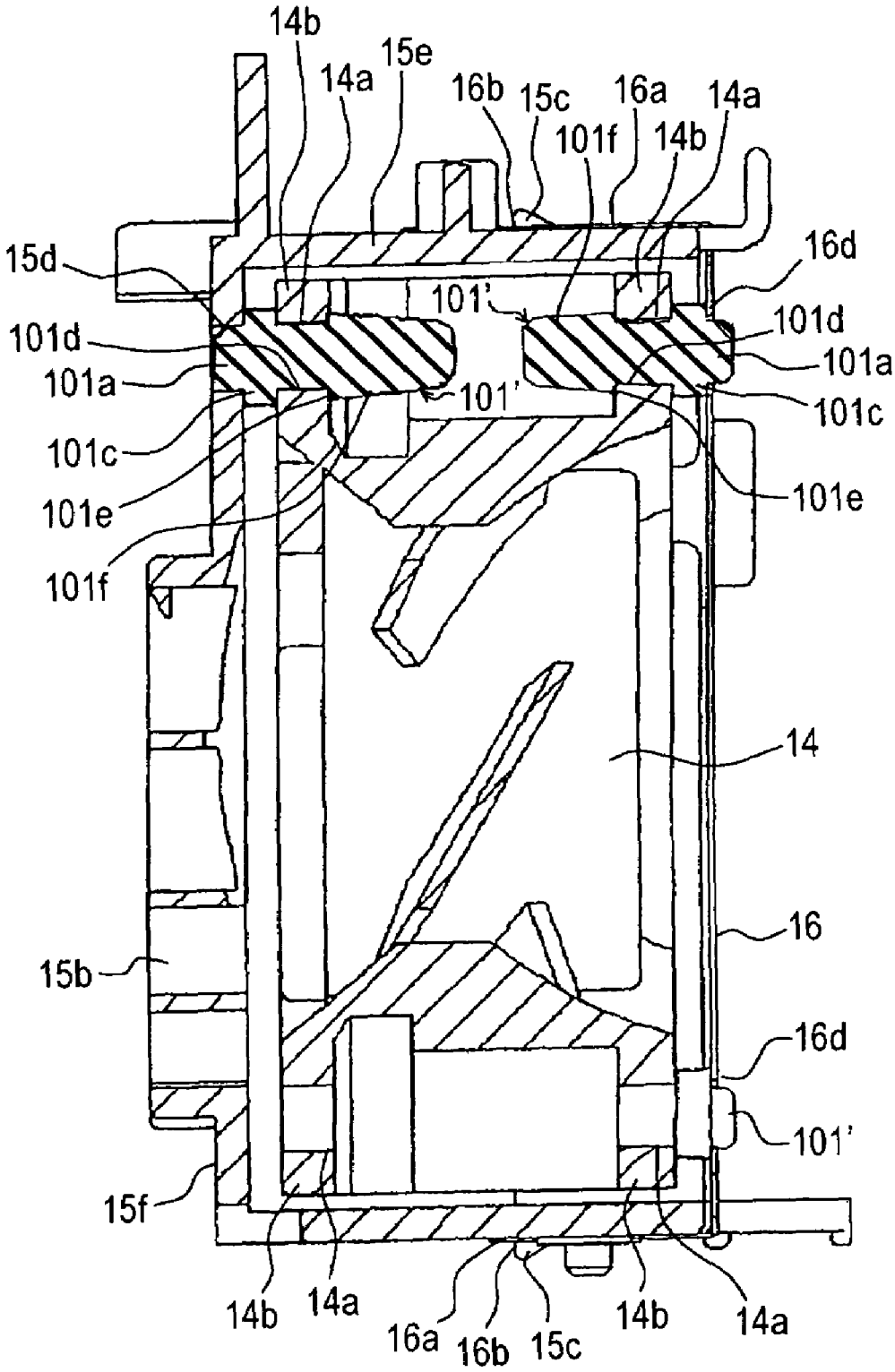
FIG. 5 illustrates a sectional view of a fan unit according to a second exemplary embodiment.

FIG. 5 illustrates the structure of a fan unit according to a second exemplary embodiment. In the second exemplary embodiment, identical elements to those illustrated and described in relation to the first exemplary embodiment are designated by identical reference numerals, and therefore, the descriptions are not repeated.

In the first exemplary embodiment, one integrated resilient supporting shaft 101 inserted into the two mounting holes 14*a* on the intake side and the exhaust port side is employed. In the second exemplary embodiment, two resilient supporting shafts 101' are separately inserted into the two mounting holes 14*a*.

Although the resilient supporting shaft 101 of the first exemplary embodiment has two bearing portions 101*a* and 101*b*, the resilient supporting shaft 101' according to this embodiment has only the bearing portion 101*a*, the large-diameter portion 101*c*, the small-diameter-A portion 101*d*, the middle-diameter portion 101*e*, and the tapered portion 10*f*. The tapered portion 101*f* of the resilient supporting shaft 101' is inserted into the mounting holes 14*a* (each of the mounting holes 14*a* on the intake port side and the exhaust port side and each of the diagonally-disposed mounting holes 14*a*) first. The resilient supporting shaft 101' is then attached to the lamp cooling fan 14 such that the mounting hole 14*a* is sandwiched between the large-diameter portion 101*c* and the middle-diameter portion 101*e*.

Thereafter, by inserting the bearing portion 101*a* of the resilient supporting shaft 101' into the notch portion 15*d* of the fan holding platform 15 or the notch portion 16*d* of the fan retainer plate 16, the lamp cooling fan 14 is supported by the fan holding platform 15 and the fan retainer plate 16 while being suspended.

Like the first exemplary embodiment, the vibration of the lamp cooling fan 14 transferred to the fan holding platform 15 is reduced. Where in at least one exemplary embodiment the reduction is due to vibration damping effects resulting from the elasticity of the resilient supporting shaft 101' itself and the small contact areas between the bearing portion 101*a* and the notch portion 15*d* and between the bearing portion 101*a* and the notch portion 16*d*. Thus at least one exemplary embodiment facilitates the reduction of the occurrence of noise. Additionally at least one exemplary embodiment further facilitates reducing the tilt of the lamp cooling fan 14 with respect to the fan holding platform 15. Therefore, cooling air appropriately flows from the lamp cooling fan 14 to the lamp unit 1.

As described above, according to the second exemplary embodiment, by supporting a resilient supporting shaft attached to a fan at two points separated in the axis direction of the resilient supporting shaft, a fan unit can be assembled without using screwing. Accordingly, the assembly operation is facilitated. In addition, since the resilient supporting shaft is not compressed by screwing, the vibration dampening performance is not appreciably reduced. Thus, vibration transferred from the fan to the supporting member can be effectively reduced. Accordingly, the noise is sufficiently reduced. Moreover, since the fan is supported at the both ends, the tilt of the fan due to its own weight can be reduced, thus more accurately delivering cooling air to the desired location.

Furthermore, the supporting member consists of a first member and a second member which support the resilient supporting shaft at two spaced positions in the axis direction of the resilient supporting shaft. Accordingly, the fan unit having the above-described vibration-dampening effect can easily be installed in a variety of apparatuses. That is, the fan unit becomes versatile. This facilitates the reduction in the total cost of the apparatuses.

Still furthermore, the fan shown is an axial fan. The resilient supporting shaft is inserted into the mounting holes which an axial fan generally have. Consequently, a simple operation to insert the resilient supporting shaft into the known axial fan provides a vibration-dampening effect.

In the above-described embodiments, the case where an axial fan blows cooling air to a cooling object (lamp unit) is described. However, according to the present invention, the fan is not limited to an axial fan. Alternatively, the fan may be a fan of another type, such as a sirocco fan and a cross flow fan. In this case, the direction of the rotation shaft of the fan may be different from the axis direction of a resilient member. Additionally, a fan that produces cooling air by drawing air in a cooling space may be employed. Moreover, the cooling object may be an object other than a lamp unit, for example, a power supply, a circuit board, and an optical element.

Furthermore, in the above-described exemplary embodiments, a solid resilient supporting shaft is used. However, a resilient supporting member of another type may be used, such as a hollow resilient supporting member of a bush type.

Still furthermore, in the above-described exemplary embodiments, a fan unit is included in an image projection apparatus. However, a fan unit according to the present invention can be used to cool a heating element in another optical apparatus, such as a photolithography machine and a copier.

Additionally in at least one exemplary embodiment the resilient support shaft 101 can be attached to only one support structure (e.g., 16 or 15), while a separate structure supports the other end of the fan.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-271037 filed Sep. 17, 2004, which is hereby incorporated by reference herein in its entirety.

What is claimed is:

1. A fan unit comprising:

a fan;

a supporting member configured to support the fan; and a resilient member operatively connected to the fan, the resilient member comprising a first bearing portion, a second bearing portion, and a holding portion; wherein the second bearing portion is spaced from the first bearing portion in the axis direction of the resilient member, the holding portion holds the fan spaced from the first bearing portion and the second bearing portion, and the supporting member includes a first supporting portion and a second supporting portion for supporting the first bearing portion and the second bearing portion of the resilient member respectively.

2. The fan unit according to claim 1, wherein the resilient member is one integrated member extending from the first supporting portion to the second supporting portion.

3. The fan unit according to claim 1, wherein the fan is an axial fan and the axis direction of the resilient member is substantially parallel to the direction of a rotation shaft of the fan.

4. The fan unit according to claim 1, wherein the supporting member comprises a first member including the first supporting portion and a second member including the second supporting portion.

5. The fan unit according to claim 1, wherein the supporting member is an air guiding member for guiding air from the fan towards at least one direction.

6. The fan unit according to claim 1, wherein the resilient member is attached to each of two diagonal locations with the center of a ventilating opening of the fan therebetween.

7. A computer comprising:

a microprocessor, wherein the microprocessor generates heat when operated; and a fan unit according to claim 1 configured to cool the microprocessor.

8. An optical apparatus comprising:

a heating element;

a fan for cooling the heating element;

a supporting member configured to support base of the fan; and a resilient member operatively connected to the fan, the resilient member comprising a first bearing portion, a second bearing portion, and a holding portion; wherein the second bearing portion is spaced from the first bearing portion in the axis direction of the resilient member, the holding portion holds the fan spaced from the first bearing portion and the second bearing portion, and the supporting member includes a first supporting portion and a second supporting portion for supporting the first bearing portion and the second bearing portion of the resilient member respectively.

9. A projector comprising:

a heating element;

a fan for cooling the heating element;

a supporting member configured to support the fan; and a resilient member operatively connected to the fan, the resilient member comprising a first bearing portion, a second bearing portion, and a holding portion; wherein the second bearing portion is spaced from the first bearing portion in the axis direction of the resilient member, the holding portion holds the fan spaced from the first bearing portion and the second bearing portion, and the supporting member includes a first supporting portion and a second supporting portion for supporting the first bearing portion and the second bearing portion of the resilient member respectively.

10. A fan unit comprising:

a fan;

a supporting member configured to support the fan; and a first resilient member operatively connected to the fan; and a second resilient member operatively connected to the fan;

wherein the supporting member includes a first supporting portion and a second supporting portion, and wherein the first resilient member and the second resilient member comprise a bearing portion supported by the first supporting portion and the second supporting portion, and comprise a holding portion for holding the fan spaced from the bearing portion.

* * * * *